US008302830B1

(12) United States Patent
Jensen

(10) Patent No.: US 8,302,830 B1
(45) Date of Patent: Nov. 6, 2012

(54) SHOULDER HOLSTER FOR OXYGEN TANKS

(76) Inventor: A. Lee Jensen, Albuquerque, NM (US); Sharon Louise Jensen, legal representative, Albuquerque, NM (US)

( * ) Notice: Subject to any disclaimer, the term of this patent is extended or adjusted under 35 U.S.C. 154(b) by 792 days.

(21) Appl. No.: 12/315,535

(22) Filed: Dec. 4, 2008

(51) Int. Cl.
*A45F 3/02* (2006.01)
*A45F 3/04* (2006.01)
*A45F 3/08* (2006.01)
*A45F 3/14* (2006.01)

(52) U.S. Cl. ..... 224/625; 224/626; 224/637; 224/262; 224/257

(58) Field of Classification Search ..... 224/625, 224/626, 637, 262, 257, 930
See application file for complete search history.

(56) References Cited

U.S. PATENT DOCUMENTS

| | | | | | |
|---|---|---|---|---|---|
| 1,601,963 | A | * | 10/1926 | Arth | 224/193 |
| 2,089,402 | A | * | 8/1937 | Murray | 224/624 |
| 2,146,570 | A | * | 2/1939 | Gordon, S. | 381/323 |
| 2,372,971 | A | * | 4/1945 | Moore | 224/624 |
| 2,396,118 | A | * | 3/1946 | Ohlemeyer | 224/198 |
| 3,648,906 | A | * | 3/1972 | Ross | 224/605 |
| 3,797,715 | A | * | 3/1974 | Scialdone | 224/587 |
| 3,847,315 | A | * | 11/1974 | Bianchi | 224/616 |
| 4,068,784 | A | * | 1/1978 | Angell | 224/198 |
| 4,212,418 | A | | 7/1980 | Bianchi | |
| 4,260,089 | A | | 4/1981 | Daleo | |
| 4,346,827 | A | | 8/1982 | Bianchi et al. | |
| 4,438,764 | A | | 3/1984 | Eppolito | |
| 4,560,193 | A | | 12/1985 | Beebe | |
| 4,721,238 | A | * | 1/1988 | Shoemaker | 224/243 |
| 4,739,913 | A | | 4/1988 | Moore | |
| 4,750,652 | A | * | 6/1988 | Grant | 224/627 |
| D305,078 | S | | 12/1989 | Moore | |
| D346,495 | S | * | 5/1994 | Morrissey | D3/218 |
| 5,320,342 | A | * | 6/1994 | Houck | 473/450 |
| 5,358,159 | A | * | 10/1994 | Lundie, Jr. | 224/624 |
| D370,776 | S | * | 6/1996 | Frey | D3/218 |
| D373,018 | S | * | 8/1996 | Alberti | D3/218 |
| 5,586,704 | A | | 12/1996 | Alexander et al. | |
| 5,653,367 | A | * | 8/1997 | Abramson | 224/581 |
| D430,400 | S | | 9/2000 | Harper | |
| 6,209,769 | B1 | * | 4/2001 | Seals et al. | 224/583 |
| 6,390,346 | B1 | * | 5/2002 | Thomas | 224/605 |
| 6,568,575 | B1 | * | 5/2003 | Bartholomew | 224/583 |
| 6,719,178 | B1 | * | 4/2004 | Taylor | 224/148.7 |
| D528,657 | S | | 9/2006 | Adams et al. | |
| 2008/0011800 | A1 | * | 1/2008 | Vandevere | 224/625 |

* cited by examiner

*Primary Examiner* — Nathan J Newhouse
*Assistant Examiner* — Lester L Vanterpool
(74) *Attorney, Agent, or Firm* — Montgomery Patent & Design, LLC; Robert C. Montgomery; Joseph Yaksich

(57) ABSTRACT

A device aid in the retention and transportation of small oxygen bottles worn by a user during use is herein disclosed, comprising a somewhat larger and cylindrical holster to hold a type "B" oxygen canister which is approximately twelve (12) inches long and three (3) inches in diameter. The device uses a formed shoulder strap available in two different models for specific right or left hand use. The formed radius of the strap forces the strap up onto the shoulder and makes the device conform securely to the user. A retention strap that goes under the opposite arm also aids in this retention. The device can be worn while sitting, walking, standing or performing most normal activities.

12 Claims, 2 Drawing Sheets

SHOULDER HOLSTER FOR OXYGEN TANKS

RELATED APPLICATIONS

The present invention was first described in a notarized Official Record of Invention on Aug. 28, 2007, that is on file at the offices of Montgomery Patent and Design, LLC, the entire disclosures of which are incorporated herein by reference.

FIELD OF THE INVENTION

The present invention relates generally to a device aid in the retention and transportation of small oxygen bottles worn by a user during use and, more particularly, to said device comprising a holster to hold a type "B" oxygen canister, which is approximately twelve (12) inches long and three (3) inches in diameter, and available in two (2) different models for specific right or left hand use.

BACKGROUND OF THE INVENTION

Many people due to their medical condition rely upon supplemental oxygen therapy to assist them in carrying out the normal activities of living. Medical oxygen is seeing increased usage in the home environment given the recent push to reduce hospital stays. In many instances, users carry a small canister of oxygen commonly called a 'size B" tank. While such tanks provide an adequate supply of oxygen for most activities, they do suffer from the fact that they must be carried about. Many users carry them on their back or in a small handbag. This encumbers their user in their daily activities such as walking, standing or sitting. In fact, they may be so encumbering, that many users will go without the oxygen thus risking their health. Accordingly, there is a need for a means by which small oxygen tanks can be transported without the disadvantages as described above. The development of the device described herein fulfills this need.

Typically, backpack type or bag type carriers are used to house medical oxygen cylinders for portable use. These devices all suffer from being bulky and uncomfortable if worn. Further, it is difficult when outerwear is necessary to wear coats over these devices. The device described herein, due to its profile characteristics and conformation to the wearer, permits one to wear outer clothing over the device and eliminates the need to separately carry a portable oxygen tank for use in supplemental oxygen therapy situations.

There have been attempts in the past to provide carrying devices for portable oxygen tanks. U.S. Pat. No. D 528,657 issued to Adams et al discloses a backpack device for carrying a portable oxygen tank. Unfortunately, this design patent does not appear to be similar in appearance to the instant device, nor does it appear to disclose a holster for an oxygen body that lies underneath the armpit of a user and comprises a chest strap for added stability.

U.S. Pat. No. D 430,400 issued to Harper discloses a backpack type carrier for portable oxygen. Unfortunately, this design patent does not appear to be similar in appearance to the instant device, nor does it appear to disclose a holster for an oxygen body that lies underneath the armpit of a user and comprises a chest strap for added stability.

U.S. Pat. No. 5,586,704 issued to Alexander et al appears to disclose a shoulder holster for a portable telephone. Unfortunately, this patent does not appear to disclose a shoulder holster for an oxygen tank, nor does it appear to comprise a chest strap for added support of the holster on a user.

U.S. Pat. No. D 305,078 issued to Moore discloses a backpack-type carrier for a portable oxygen tank. Unfortunately, this design patent does not appear to be similar in appearance to the disclosed device, nor does it fit conveniently under the armpit of a user.

U.S. Pat. No. 4,739,913 issued to Moore comprises a backpack type carrier for portable oxygen dispensers. Unfortunately, this patent does not disclose a shoulder holster for oxygen tanks that utilizes a strapping system to secure a portable oxygen tank under the armpit of a user.

U.S. Pat. No. 4,560,193 issued to Beebe discloses a manual carrying device for transporting a cylindrical tank that appears to comprise a strap that is fitted around an oxygen tank to which a handle is attached. Unfortunately, this patent does not appear to disclose a shoulder holster for oxygen tanks that comprises a self-contained means of transporting a portable oxygen tank on a user's body.

U.S. Pat. No. 4,438,764 issued to Eppolito discloses an oxygen bottle caddy that appears to be secured to the back of a wearer. Unfortunately, this design patent does not appear to be similar in appearance to the disclosed device, nor does it fit conveniently under the armpit of a user.

U.S. Pat. No. 4,346,827 issued to Bianchi et al. discloses a vestlike weapon carrier that appears to comprise two shoulder straps connected by a chest and back strap. Unfortunately, this patent does not disclose a shoulder holster for oxygen tanks that comprises a single shoulder strap that is stabilized by a chest strap.

U.S. Pat. No. 4,260,089 issued to Daleo discloses a shoulder holster that secures to a wearer's garment. Unfortunately, this patent does not appear to disclose a shoulder holster that accepts an oxygen tank, nor does the patent appear to disclose a chest strap to the shoulder holster.

U.S. Pat. No. 4,212,418 issued to Bianchi discloses a shoulder holster with improved shoulder strap arrangement comprising a broadened support area and a narrow holster engaging portion. Unfortunately, this patent does not appear to disclose a shoulder holster that is capable of accepting a portable oxygen tank, nor does the patent appear to utilize the same strapping members and arrangement as the disclosed device.

None of the prior art particularly describes a device aid in the retention and transportation of small oxygen bottles worn by a user during use comprising a holster to hold a type "B" oxygen canister and available in two (2) different models for specific right or left hand use that the instant device possesses. Accordingly, there exists a need for a means by which small oxygen tanks can be transported without the disadvantages as described above.

SUMMARY OF THE INVENTION

In light of the disadvantages present in the prior art, it is apparent that there is a need for a portable oxygen shoulder holster which provides a means for aiding in the transportation and retention of small sized type "B" oxygen canisters worn by a user.

An object of the shoulder holster for oxygen tanks comprises a light-weight durable material, such as leather or nylon.

Another object of the shoulder holster for oxygen tanks comprises a chest strap that prevents movement of the oxygen tank.

A further object of the shoulder holster for oxygen tanks is that it may be worn under most outerwear.

Still another object of the shoulder holster for oxygen tanks is that the convenient nature of the holster eliminates many of the problems that cause patients requiring oxygen therapy to not carry their personal oxygen tank with them.

Still a further object of the shoulder holster for oxygen tanks is that it provides rapid access to the oxygen bottle for ease of replacement.

Yet another object of the shoulder holster for oxygen tanks is provided in two (2) different design models for a specific right-hand or a left-hand use.

An aspect of the shoulder holster for oxygen tanks comprises a canister holder, a shoulder strap, and a plurality of adjustment means allowing said device to conform securely to the body of the user when worn while not in interfering with sitting, walking, standing, or other normal activities.

Another aspect of the shoulder holster for oxygen comprises a canister holder envisioned to accommodate a type "B" portable oxygen canister which is downwardly inserted into said canister holder.

A further aspect of the shoulder holster for oxygen tanks comprises an apron that is permanently attached to the canister holder and which acts as a support yoke for the canister holder, thereby protecting the underarm area of the user from the oxygen canister.

Still another aspect of the shoulder holster for oxygen tanks comprises a cover flap that folds over and covers the stem and valve assembly of the oxygen canister after insertion into the canister holder. The cover flap is removably attached to the canister holder by means of a cover fastener.

Still a further aspect of the shoulder holster for oxygen tanks comprises a shoulder strap that allows the holster to rest securely upon the shoulder of the user while pulling the apron into the body of the user.

Yet another aspect of the shoulder holster for oxygen tanks comprises a first adjustment point to allow the user the ability to adjust the shoulder strap to an appropriate size.

Yet a further aspect of the shoulder holster for oxygen tanks comprises a second adjustment point comprising a plurality of adjustment slots to allow for adjustment of a rear chest strap. The rear chest strap connects the shoulder strap to a front chest strap. The rear chest strap removably attaches to the front chest strap at a third adjustment point comprising a tongue buckle located on said rear chest strap and a plurality of buckle apertures located on said front chest strap.

Still a further aspect of the shoulder holster for oxygen tanks comprises a loop to hold an excess portion of the front chest strap after attachment to the rear chest strap at the third adjustment point.

Still another aspect of the shoulder holster for oxygen tanks comprises a "D"-ring which is permanently attached to the shoulder strap by a hook. A canister ring is removably attached to the "D"-ring.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

| | |
|---|---|
| 10 | portable oxygen shoulder holster |
| 20 | canister holder |
| 22 | apron |
| 30 | cover flap |
| 32 | cover fastener |
| 40 | shoulder strap |
| 41 | first adjustment point |
| 42 | laces |
| 44 | second adjustment point |
| 45 | adjustment slot |
| 46 | "D"-ring |
| 50 | rear chest strap |
| 52 | rear fastener |
| 54 | third adjustment point |
| 56 | buckle |
| 58 | loop |
| 60 | front chest strap |
| 62 | buckle aperture |
| 64 | hook |
| 70 | canister ring |
| 80 | oxygen canister |
| 82 | oxygen tubing |
| 100 | user |

DETAILED DESCRIPTION OF THE PREFERRED EMBODIMENT

Figure 1:
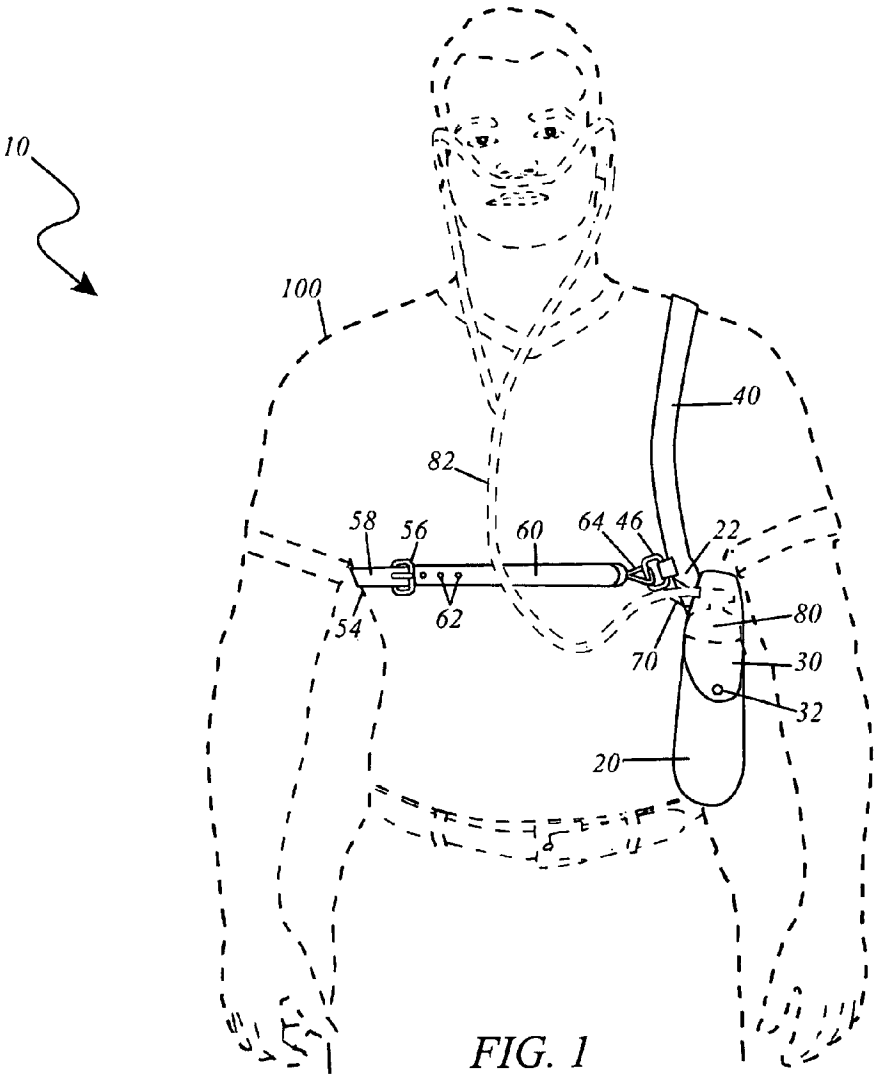
FIG. 1 is an environmental view of a portable oxygen shoulder holster 10, according to a preferred embodiment of the present invention; and, FIG. 2 is a front perspective view of a portable oxygen shoulder holster 10, according to a preferred embodiment of the present invention.
Figure 2:
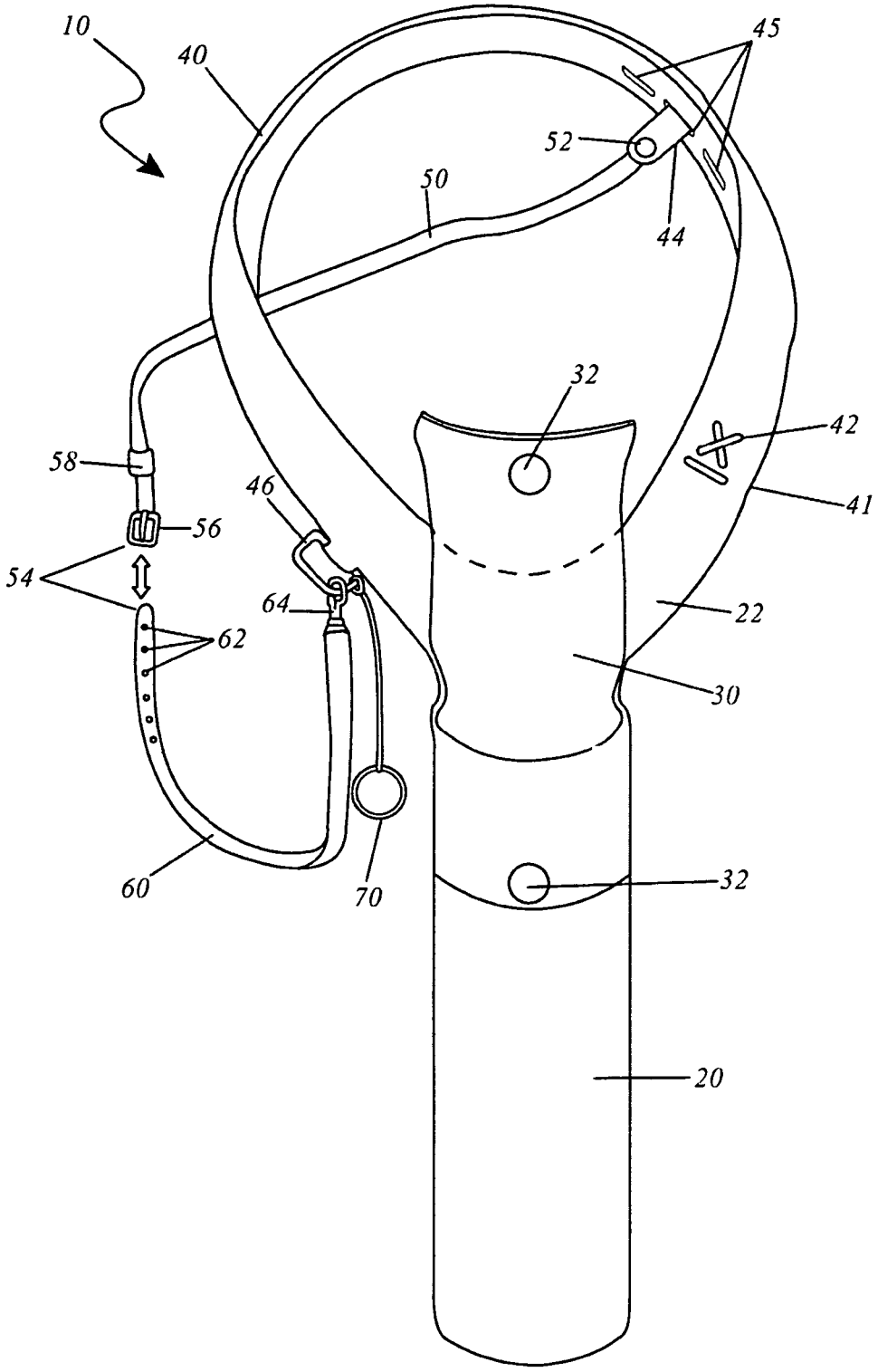

The best mode for carrying out the invention is presented in terms of its preferred embodiment, herein depicted within FIGS. 1 and 2. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a device and method for a portable oxygen shoulder holster (herein described as the "device") 10, which provides a means for aiding in the transportation and retention of small sized type "B" oxygen canisters 80 worn by a user 100. The device 10 comprises generally a canister holder 20, a shoulder strap 40, and a plurality of adjustment means allowing said device 10 to conform securely to the body of the user 100 when worn while not in interfering with sitting, walking, standing, or other normal activities.

Referring now to FIG. 1, an environmental view the device 10, according to the preferred embodiment of the present invention, is disclosed. The device 10 is preferably made of a light-weight durable material, such as leather or nylon, and fabricated through common textile cutting and assembly methods. The device 10 comprises a canister holder 20 envisioned to accommodate a type "B" portable oxygen canister 80 approximately twelve (12) inches long and three (3) inches in diameter which is downwardly inserted into said canister holder 20. The device 10 also comprises an apron 22 envisioned to be permanently attached to an upper rear outside surface of the canister holder 20 and extending above the opening of said holder 20 which acts as a support yoke for said canister holder 20 and protects the underarm area of the user 100 from the oxygen canister 80 when worn. The device 10 also comprises a cover flap 30 envisioned to fold over and cover the stem and valve assembly of the oxygen canister 80 after insertion into the canister holder 20 and allowing the oxygen tube 82 to extend outward. The cover flap 30 is envisioned as removably attaching to the canister holder 20 by means of a cover fastener 32 illustrated as a snap, although said fastener 32 may be introduced in a variety of fastening means such as, a button, a common hook-and-loop fastener, a magnet, or the like and as such should not be viewed as a limiting factor of the invention 10. The device 10 further comprises a shoulder strap 40 envisioned to be approximately one and one-half (1½) inches wide which extends outward from the apron 22 around the shoulder of the user 100. The shoulder strap 40 is envisioned as cut in a predetermined radius allowing the device 10 to rest securely thereupon the shoulder of the user 100 while pulling the apron 22 into the body of the user 100.

Referring now to FIG. 2, a front perspective view of the device 10, according to the preferred embodiment of the present invention, is disclosed. The device 10 comprises a first adjustment point 41 envisioned to allow the user 100 the ability to adjust the shoulder strap 40 to an appropriate size; herein illustrated as comprising laces 42. Said first adjustment point 41 may be introduced in a variety of different adjustment means such as, a hook-and-loop fastener, an adjustment buckle, a cam and spring buckle, a tongue buckle, a snap, or the like, and as such should not be viewed as a limiting factor of the invention. The device 10 also comprises a second adjustment point 44 located on the rear side of the shoulder strap 40 comprising a plurality of adjustment slots 45 envisioned to allow for adjustment of a rear chest strap 50. The rear chest strap 50 is envisioned as engaging therethrough the adjustment slot 45 and folding back on and connecting to itself by means of a rear fastener 52, preferably a snap. Although the second adjustment point 44 is illustrated comprising the adjustment slot 45 and rear fastener 45 snap it may be introduced in a variety of different attachment means such as, a hook-and-loop fastener, a strap adjuster, or the like and as such should not be viewed as a limiting factor of the invention 10. The rear chest strap 50 is envisioned as one half (½) inch wide and connecting the shoulder strap 40 to a front chest strap 60. The rear chest strap 50 removably attaches to the front chest strap 60 at a third adjustment point 54 comprising a tongue buckle 56 located on said rear chest strap 50 and a plurality of buckle apertures 62 located on said front chest strap 60. Although illustrated using a tongue buckle 56 and buckle apertures 62 the third adjustment point 54 may be introduced in a variety of different attachment means such as, a side release buckle, a hook-and-loop fastener, a cam and spring buckle, or the like and as such should not be viewed as a limiting factor of the invention 10. The device also comprises a loop 58 envisioned to hold an excess portion of the front chest strap 60 after attaching to the rear chest strap 40 at the third adjustment point 54. The rear chest strap 50 and front chest strap 60 once connected and adjusted are envisioned to loop around the back, under an arm opposite the device 10, and over the chest of the user 100 securing said device 10. The device 10 also comprises a "D"-ring 46 which is permanently attached to the front surface of the shoulder strap 40. The front chest strap 60 removably attaches to the "D"-ring 46, by means of a hook 64 preferably an eye hook, a spring clip, a bolt snap, or the like. The device 10 also comprises a canister ring 70 envisioned as removably attached thereto the "D"-ring 46 by looping over the stem portion of the oxygen canister 80 thus providing additional stability.

It is envisioned the device 10 will be introduced in two (2) different design models for a specific right-hand or a left-hand use.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIGS. 1 and 2.

The method of utilizing the device 10 may be achieved by performing the following steps: taking the device 10 in hand; determining if the user 100 has a right-handed or a left-handed model of the device 10; inserting an arm therethrough the opening provided by the connected shoulder strap 40 and apron 22; resting the shoulder strap 40 on top of a shoulder; determining if the shoulder strap 40 is fitted properly; removing the device 10 from the shoulder if said device 10 needs adjustment; adjusting the size of the shoulder strap 40 at the first adjustment point 41; unlacing the lace 42; lengthening or shortening the shoulder strap 40 to the desired size; relacing the lace 42; replacing the shoulder strap 40 back on the shoulder; connecting the rear chest strap 50 to the front chest strap 60 via the buckle 56 at the second adjustment point 54; wrapping the connected chest straps 50, 60 around the back, under the arm opposite the device 10, and across the chest of the user 100; attaching the front chest strap 60 to the apron 22 via hooking the hook 64 to the "D"-ring 46; adjusting the tightness of the chest straps 50, 60 by lengthening or shortening said front chest strap 60 at the second adjustment point 54; engaging the buckle 56 thereto the appropriate buckle aperture 62; securing the excess end of the front chest strap 60 by sliding the loop 58 over said excess strap 60; inserting a full type "B" oxygen canister 80 in a downward motion therein the canister holder 20; placing the canister ring 70 thereover the upper stem portion of the oxygen canister 80; folding the cover flap 30 over the stem and valve portion of the oxygen canister 80; fastening the cover flap 30 thereto the canister holder 20 via engaging the cover fastener 32; ensuring oxygen tubing 82 extends outward from under the cover flap 30; utilizing the oxygen tubing 82 and oxygen canister 80 as normal; conducting normal activities; and, benefiting from the improved comfort, unencumbered movement, ease of oxygen canister 80 replacement while using the present invention 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A shoulder holster device, comprising:

a cylindrical canister holder having an open top and a closed bottom adapted to insertingly receive a portable oxygen canister;

an apron affixed to an upper rear outside surface of said canister holder to protect an underarm area of a wearer;

a shoulder strap affixed to said apron adapted to fit over a shoulder of said wearer and having a "D"-ring affixed thereto;

a chest strap connected to said shoulder strap adapted to fit around a chest of said wearer;

a first adjustment point located on said shoulder strap for adjusting a size of said shoulder strap; and, a second adjustment point located on said shoulder strap for adjusting a location of attachment of said chest strap to said shoulder strap;

wherein said chest strap further comprises:

a front chest strap comprising a first front end adjustably connected to a rear chest strap at a third adjustment point and further comprising a second front end releasably connected to said shoulder strap;

a rear chest strap comprising a first rear end adjustably connected to said shoulder strap at said second adjustment point and further comprising a second rear end adjustably connected to said front chest strap at said third adjustment point; and, a hook affixed to said second front end of said front chest strap;

wherein said shoulder strap and said chest strap are adjustable to securely conform to a body of said wearer;

wherein said second front end of said front chest strap is connected to said shoulder strap by said hook removably attaching to said "D"-ring;

wherein said device further comprises a canister ring removably attached to said "D"-ring, said canister ring removably attachable to a stem portion of said oxygen canister for providing lateral stability when retained within said canister holder; and, wherein said device retains said oxygen canister to said body of said wearer.

2. The device of claim 1, wherein said rear chest strap further comprises a loop portion for holding an excess portion of said front chest strap at said third adjustment point.

3. The device of claim 2, wherein said third adjustment point is selected from the group consisting of a tongue buckle and a plurality of buckle apertures, a side release buckle, a hook-and-loop fastener, and a cam and spring buckle.

4. The device of claim 1, wherein said rear chest strap is approximately one-half inch wide.

5. The device of claim 2, wherein said first adjustment point is selected from the group consisting of a plurality of laces, a hook-and-loop fastener, an adjustment buckle, a cam and spring buckle, a tongue buckle, and a snap.

6. The device of claim 2, wherein said second adjustment point is selected from the group consisting of a plurality of adjustment slots, a hook-and-loop fastener, and a strap adjuster.

7. The device of claim 1, wherein said device further comprises a cover flap removably attachable to said canister holder by a cover fastener wherein said cover flap secures said oxygen canister within said canister holder and allows oxygen tubing to extend outwardly.

8. The device of claim 7, wherein said cover fastener is selected from the group consisting of a snap, a button, a hook-and-loop fastener, and a magnet.

9. The device of claim 1, wherein said shoulder strap is approximately one and one-half inches wide.

10. The device of claim 1, wherein said canister holder further comprises an elongated cylindrical shape adapted to retain a type "B" portable oxygen canister approximately twelve inches long and three inches in diameter.

11. The device of claim 1, wherein said device comprises a leather material or a nylon material.

12. The device of claim 1, wherein said device is available in a right-handed model and a left-handed model.

* * * * *